US007494251B1

(12) United States Patent
Kira

(10) Patent No.: US 7,494,251 B1
(45) Date of Patent: Feb. 24, 2009

(54) LIGHTING FIXTURE WITH THERMAL ISOLATION

(76) Inventor: Hiroshi Kira, 3525 Old Conejo Rd., #107, Newbury Park, CA (US) 91320

( * ) Notice: Subject to any disclaimer, the term of this patent is extended or adjusted under 35 U.S.C. 154(b) by 176 days.

(21) Appl. No.: 11/590,696

(22) Filed: Oct. 30, 2006

(51) Int. Cl.
*F21V 29/00* (2006.01)

(52) U.S. Cl. ..... 362/294; 362/373; 362/418; 362/427

(58) Field of Classification Search ..... 362/294, 362/373, 418, 427, 371
See application file for complete search history.

(56) References Cited

U.S. PATENT DOCUMENTS 4,882,667 A * 11/1989 Skegin ..... 362/373
4,999,758 A * 3/1991 Wimberly ..... 362/373
5,651,606 A * 7/1997 Krogman ..... 362/96
7,086,759 B2 * 8/2006 Hartmann et al. ..... 362/311
7,156,541 B2 * 1/2007 Yeung ..... 362/418
7,296,909 B2 * 11/2007 Van Deursen et al. ..... 362/199

* cited by examiner

*Primary Examiner*—Jong-Suk (James) Lee
*Assistant Examiner*—Peggy A. Neils
(74) *Attorney, Agent, or Firm*—Wagner, Anderson & Bright, LLP

(57) ABSTRACT

An outdoor lighting fixture is disclosed including a first housing containing the fixture ballast or power supply, a second housing enclosing a lamp. Each of the housings is sealed. A support stem joins the two housings and defines a thermal air gap between the two. The only conductive thermal path between the two housings is through the stem and the fasteners engaging the stem and the two housings. In one embodiment, a plurality of tubular spacers are located on elongated screw fasteners define the size of air gap. In another embodiment a single fastener includes washers defining the air gap size. In that embodiment, the fastener may be hollow and acts as a conduit for the electrical leads for the fixture. In another embodiment one closure for a housing includes fins for cooling the fixture.

11 Claims, 10 Drawing Sheets

LIGHTING FIXTURE WITH THERMAL ISOLATION

BACKGROUND OF THE INVENTION

Throughout lighting industry and particularly, outdoor lighting such as walkway, flood and spot light applications, it is the desire of manufacturers and of the purchasers and the public that the lighting be reliable with lowest operating cost while meeting safe lighting requirements, require little or no maintenance and have long life. Weather, vandalism, and other factors can adversely affect the life of such fixtures and particularly their lamps and internal power supplies, such as ballasts or transformers.

The heat generated in the fixture itself in both the power supply which may be a transformer operating from typical 115-volt lines to serve low voltage lamps and the lamps themselves generate substantial heat. Heat generated by the fixture itself is a major factor in determining the operating life of the power supply or transformer and the lamp. A notable exception is solar powered lighting, however such systems rarely provide enough light for most applications where safety and reliability are controlling criteria.

The most common solution to the minimization of thermal damage to the key components, the power supply and the lamps in outdoor walkway and other architectural lighting is to provide large thermal conductive bodies such as aluminum housings which act as heat sinks and which sometimes have integral fins to aid in radiating the heat into the surrounding air. Fins, though effective, often detract from the ornamental appearance of the fixture.

An ideal shape for such outdoor walkway and other architectural applications is a cylindrical body, preferably with the power supply toward one end and the lamp assembly at the opposite end. That has given rise to fixtures with a fin section between the two heat sources with the expectation that it will serve to dissipate heat from both sections of the fixture while accepting the appearance of the fins. Examples of various finned fixtures are well known in the art.

BRIEF DESCRIPTION OF THE INVENTION

Faced with the present state of the art, one object of this invention is to provide walkway or other architectural lighting fixture with improved thermal energy removal.

Another object of this invention is to provide a lighting fixture with enhanced power supply and lamp life.

Still another object of this invention is to provide a lighting fixture in which the features responsible for enhanced thermal energy removal are virtually hidden from view.

Another object of the invention is to provide an attractive lighting fixture, which has enhanced protection from vandalism damage.

These objectives are achieved by a lighting fixture which includes a power supply housing, lamp and lamp housing or housings, a stem for mounting the fixture of metal having good thermal radiation properties assembled into an elongated structure. Internal, substantially concealed fastener or fasteners attach the housings to form one structure with a minimally visible thermal isolation air gap.

Some of the fasteners define one or more air gaps, which are located between the heat generating elements of the fixture, particularly the lamp and the power supply located in their respective housings.

The support stem for the fixture has substantial mass to radiate heat and to provide a rugged structural mount while conducting heat to whatever support to which it is attached.

Only one or two small fasteners such as setscrews, concealed at the bottom of the fixture provide access to the interior of the fixture in the event that access to the fixture is required.

In one embodiment, a single fastener joins the power supply housing to the stem and to the lamp and socket housing and constitutes the only thermal conduction path between the housings.

In other embodiments a plurality of internal fasteners joining the housings and the stem secure the entire assembly together while defining one or more air gaps and constitute the only thermal conduction path between the power supply housing, the stem and the lamp housing.

Another feature of the invention is a relatively massive swivel stem pivotally secured to the stem to provide a further thermal conduction path while conducting power leads to the stem and to the fixture providing angular adjustment of the orientation of the fixture.

BRIEF DESCRIPTION OF THE DRAWING

This invention may be more clearly understood from the following detailed description and by reference to the drawing in which.

DETAILED DESCRIPTION OF THE INVENTION

Figure 1:
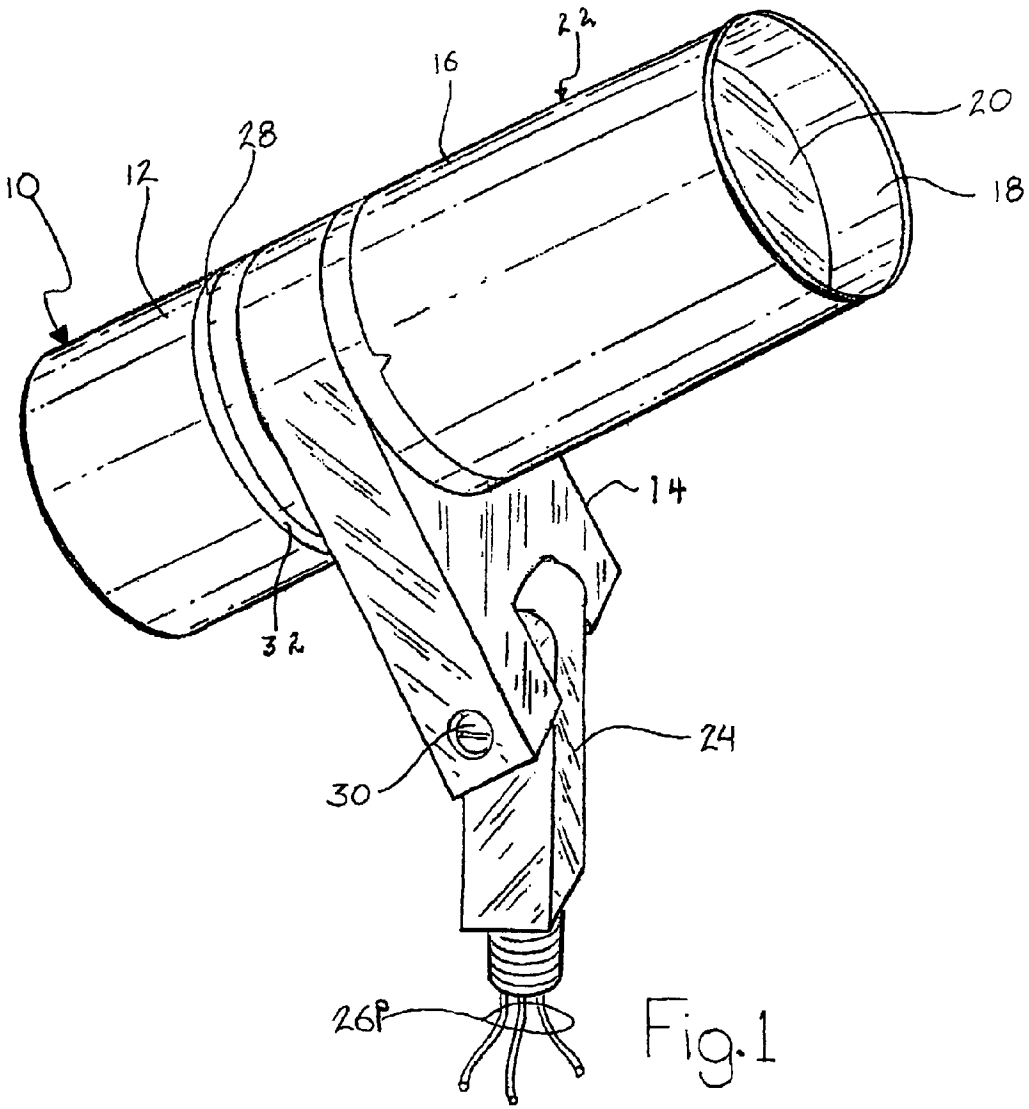
FIG. 1 is a perspective view of a lighting fixture in accordance with this invention.
Figure 2:
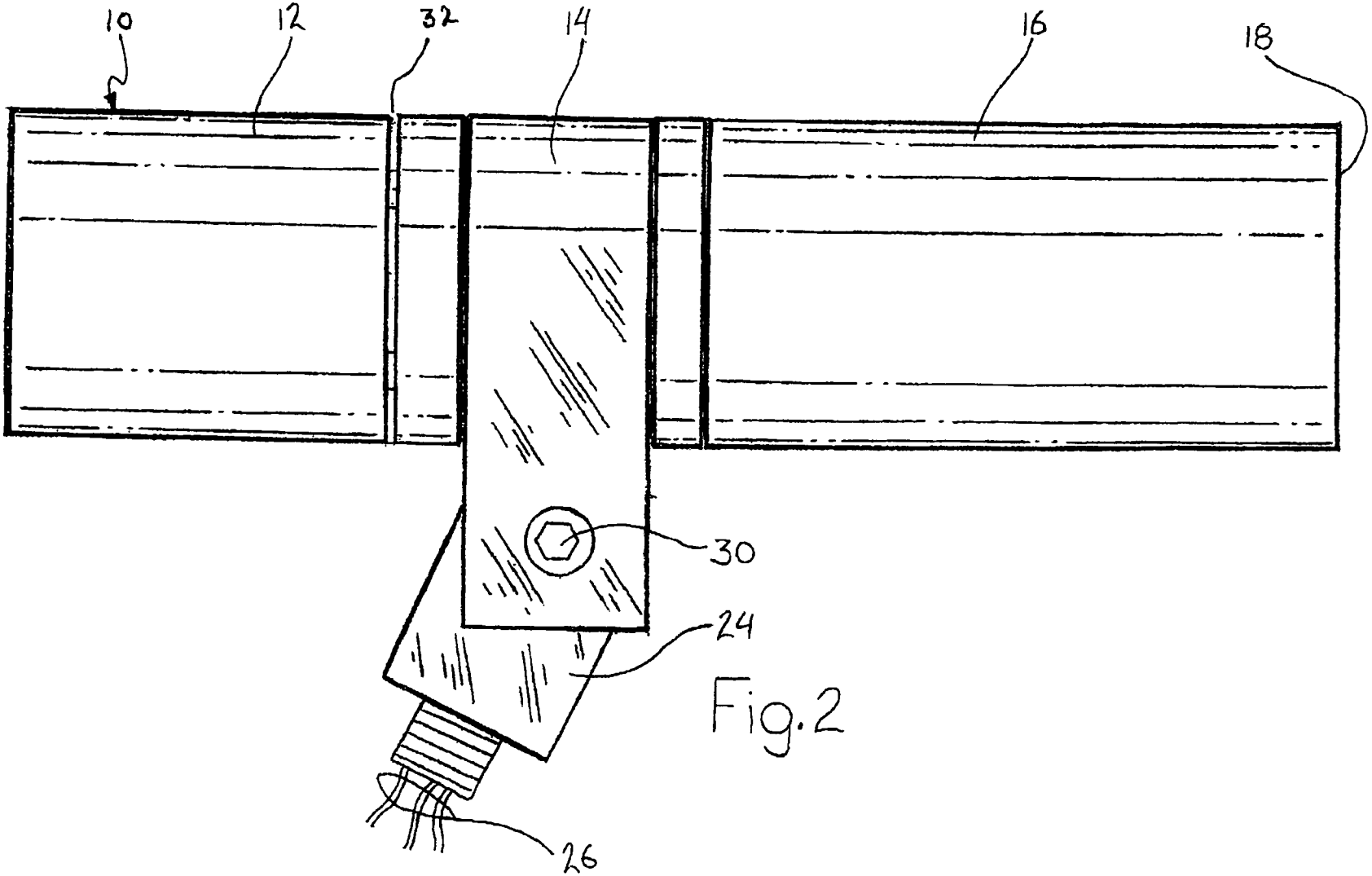
FIG. 2 is a side elevational view of the lighting fixture of FIG. 1.
Figure 3:
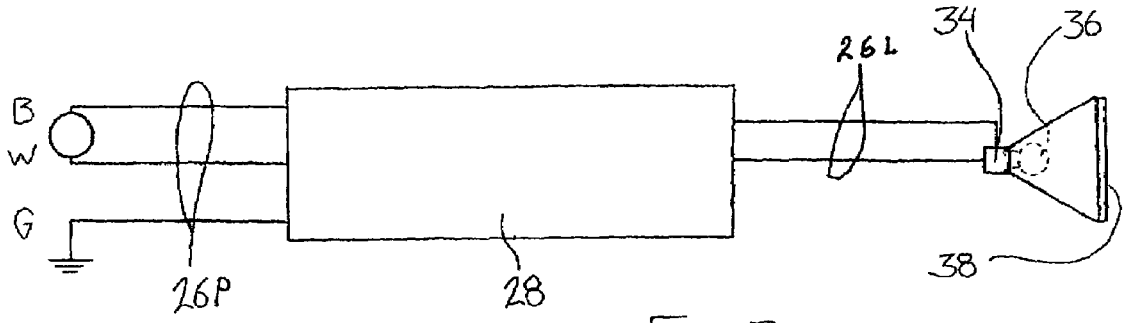
FIG. 3 is an electronic block diagram of the fixture of FIG. 1.
Figure 5:
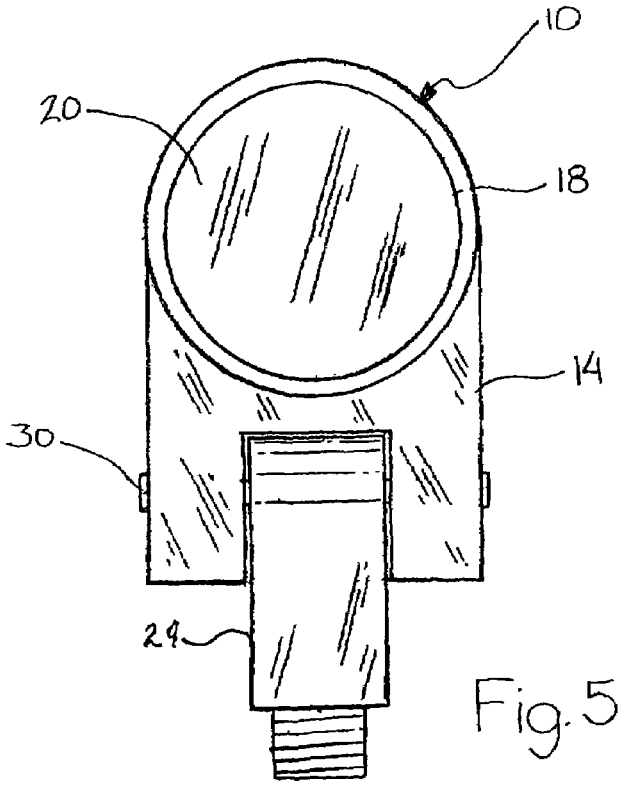
FIG. 5 is a side elevational view of the fixture of FIG. 1 with portions broken away to show internal features thereof.
Figure 4:
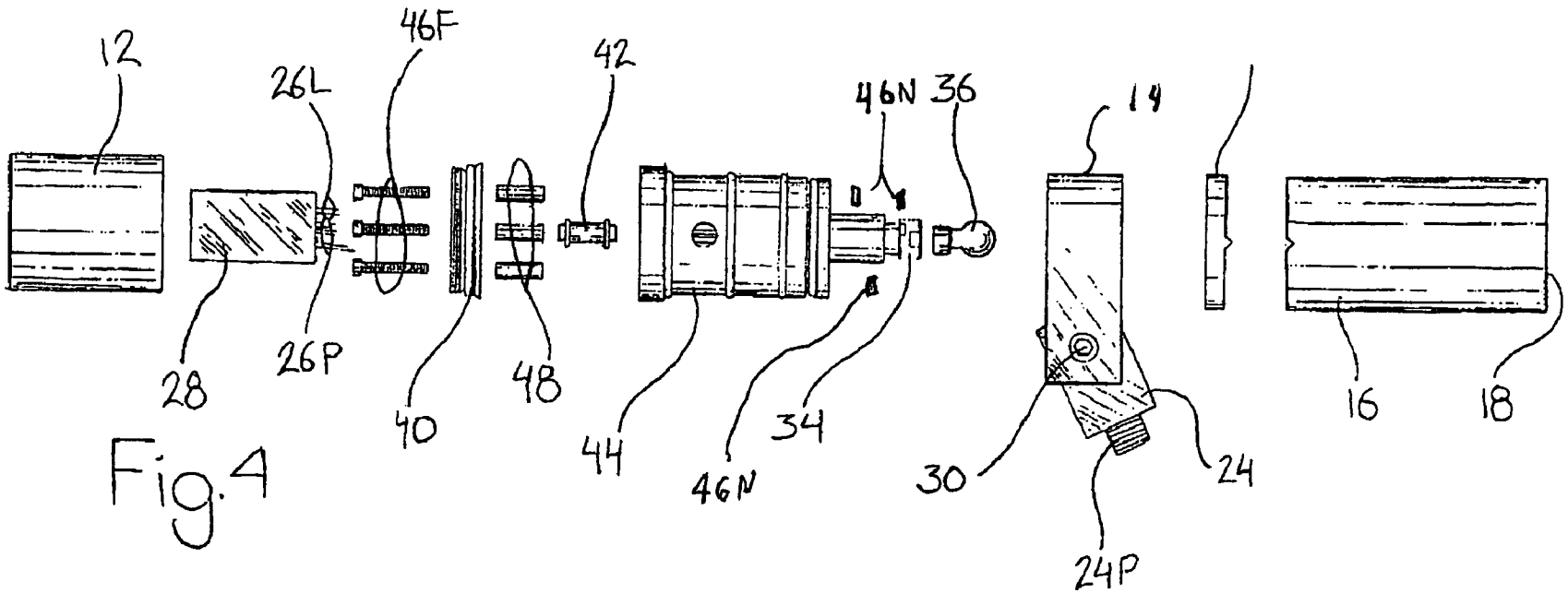
FIG. 4 is an exploded view of the fixture of FIG. 1.
Figure 6:
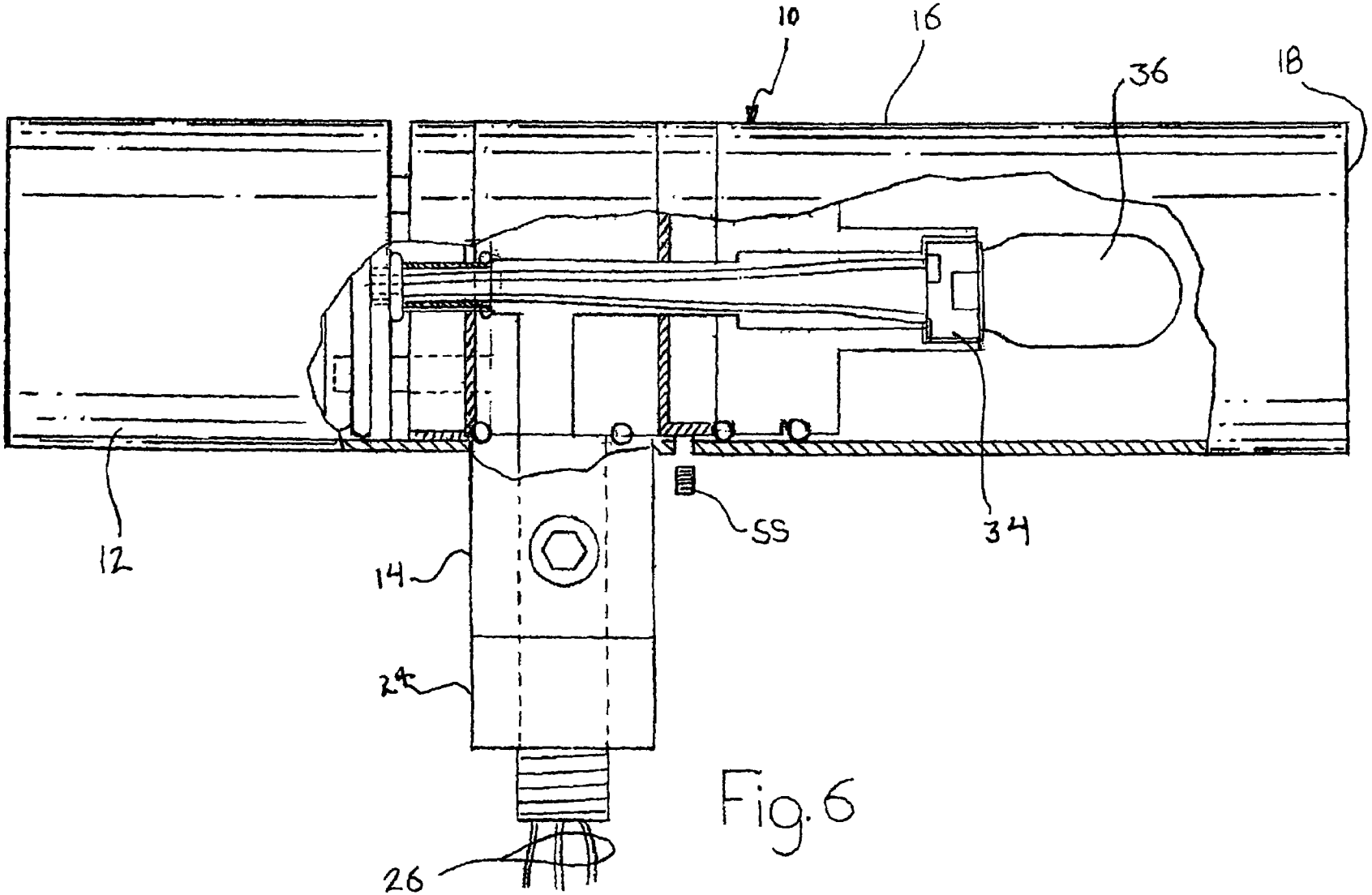
FIG. 6 is a front elevational view of the fixture of FIG. 1.

A first embodiment of this invention may be seen in FIGS. 1 through 6 with the external features appearing in FIGS. 1, 2 and 6 and the internal components in FIGS. 3 and 4 and of a lighting fixture, generally designated 10. The fixture 10 from the exterior comprises a power supply housing 12, a supporting stem 14 and a lamp and socket housing 16. The outer end of the housing 16 includes a shroud 18 as protection for the lens 20 of the fixture 10 which appears in FIGS. 1 and 6. Each of the foregoing defines an attractive, generally cylindrical body 22 with the stem 14 extending downward to constitute a support for the fixture 10. A swivel stem 24 is located at the bottom of the stem 14 and is pivotable over an angle in the order of 60 or so degrees for adjusting the direction of the light beam emitted from the fixture 10 while supplying its operating power.

The support stem 14 and the swivel stem 24 include internal openings, unshown in FIG. 1 for the passage of power leads 26P from an external power line, unshown, to the interior of the fixture 10 where mating internal openings in the stem 14 and the power supply housing 12 provide external power to the power supply 28 of FIGS. 3 and 4 to the fixture.

From the standpoint of a casual observer, the fixture 10 appears to be a virtually continuous cylindrical structure, with a base provided by the stem 14 and the swivel stem 24. Hardly noticeable is an air gap 32 which is in the order of less than ¼ inch in width extending around the body 22 adjacent to the stem where it matches the contour of the housings 12 and 16. The internal (radial) surfaces defining the air gap 32, preferably have the same color treatment as the body 22 as a whole, e.g. black finish, and become virtually invisible.

The air gap 32, as described in more detail below, in combination with the body fasteners 46F and spacer tubes of FIG. 4 are instrumental in providing enhanced thermal protection for the internal electrical components of the fixture, namely the lamp 30, its socket 32 and the power supply transformer or ballast 28 of FIGS. 3 and 4. Socket 32 is mentioned since they are commonly the first to suffer from heat damage in a fixture of any type.

Reference is now made to FIG. 3, which is a block diagram of the electronic elements of each of the embodiments of this invention. In FIG. 3, three incoming leads 26, one black, one white, both power leads and one green which is the grounding lead for the fixture 10 constitute the input to the power supply 28, identified in FIG. 3 as the ballast, the socket 34 for the lamp 36, shown in dashed lines within its reflector 38. In accordance with this invention, the power supply 28 and the lamp 36 are virtually entirely thermally isolated from each other.

For a greater understanding of the invention, reference is now made to FIG. 4, which is an exploded view of the lighting fixture of FIG. 1 showing not only the housings 12 and 16, the stem 14 and the swivel stem 24 but also showing the sealed internal power supply 28 which may be a transformer or ballast. A typical such power supply is a VS 39 watt 120 volt electronic ballast such as a Model MC39-1-F-1200 Ballast of the Hatch Transformer, Inc. when using a 39 watt PAR lamp or a 39 watt TC lamp. The ballast 28 has three input leads 26, white, black and green (ground) and two output leads to the lamp socket 34.

All of these leads extend out of the power supply (ballast) housing 12 through the housing 12 internal cover plate 40 and a lead tube 42, to the socket housing 44. The socket housing 44 is hollow and the lamp leads 26L pass directly through housing 44 and are secured and electrically connected to respective terminals of socket 34. Power leads 26P extend part way through housing 44 and exit through its sidewall through port 44P, through the mating port (unshown) of stem 14 and end port or slot of the swivel stem 24 to exit for connection to the local 120*v* power line when all is assembled and installed.

A plurality of fasteners 46F such as machine screws, extend through matching openings in cover plate 40, partially through the socket housing 44 and are secured in place by matching nuts 46N. Tubes 48 slide over respective fasteners 46 F and are of sufficient length to space the housing 12 and its cover plate 40 by ⅛ to ¼ in. from the near edge of socket housing 44 and stem 14, thereby creating air gap 32 of FIGS. 1 and 2. Each of the openings in the cover plate 40, and the housing 44 are sealed with silicone sealant or the like against any moisture. The cover plate 40 is threaded into matching threads in housing 12 and locked with a virtually hidden set screw SS on the underside of the fixture for security.

Key to this invention is the fact that the fasteners 46F and tubes 48 are the only thermal conductive path between the ballast 28, its housing 12 and the lamp 36 and its housing 16. The entire body assembly 22, the stem 14 and the swivel stem 24 constitute a thermal radiating body with an air gap 32 isolating the thermal conduction path between the two heat generating elements, the ballast 28 and the lamp 36 so neither can effectively transfer heat energy to the other.

FIRST ALTERNATE EMBODIMENT

Figure 7:
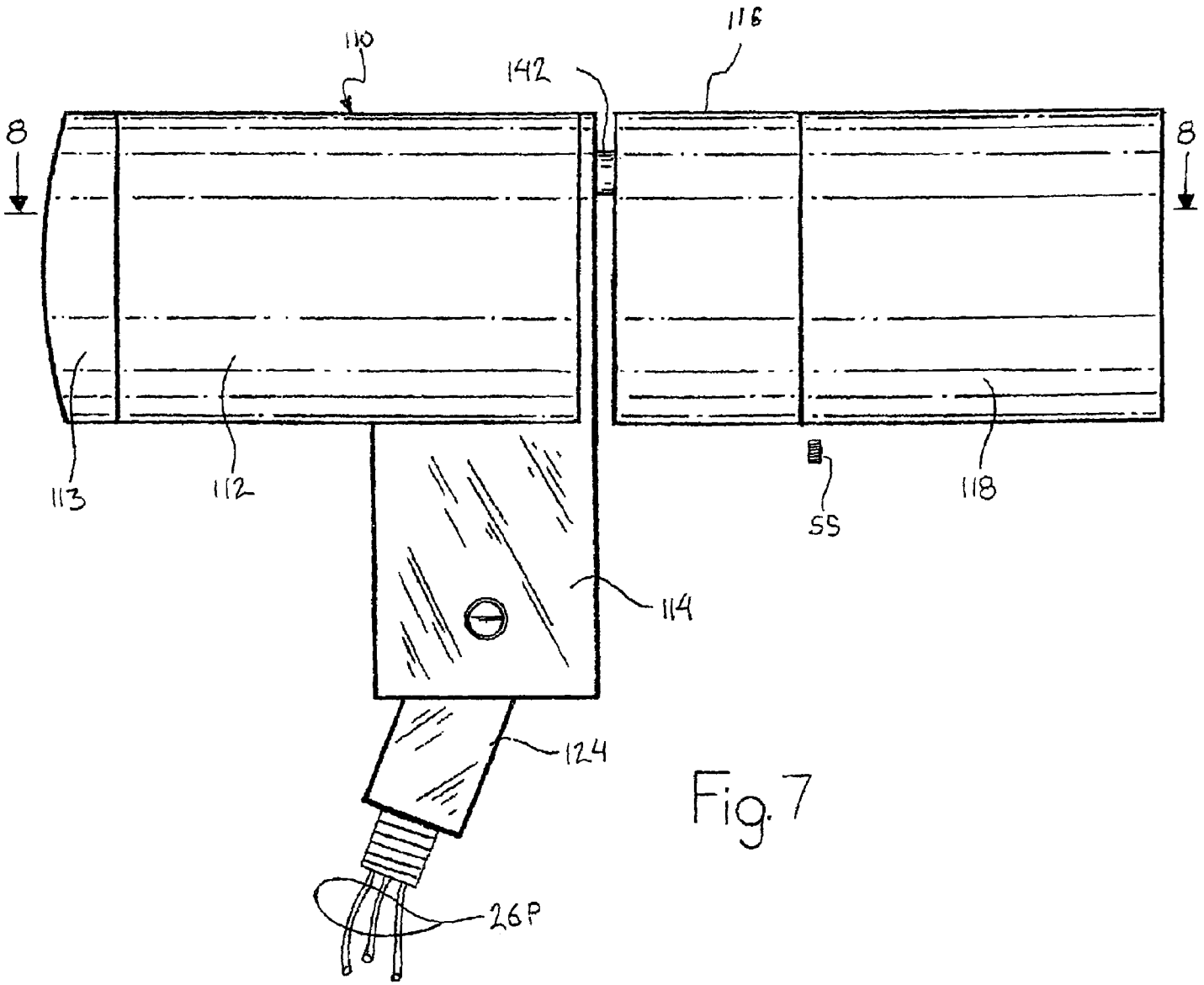
FIG. 7 is a side elevational view of a first alternate embodiment of this invention.
Figure 8:
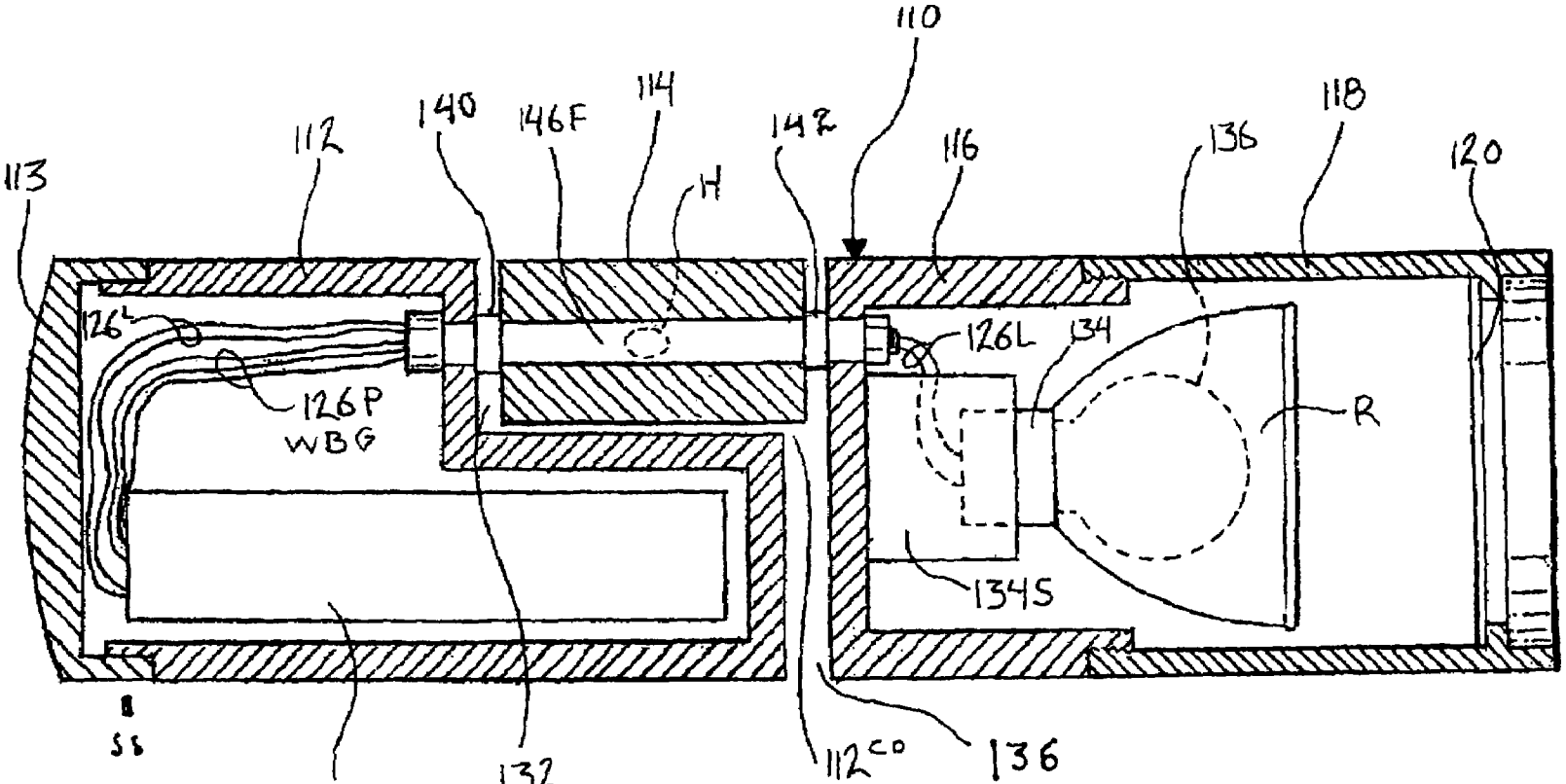
FIG. 8 is a longitudinal sectional view of the first alternative embodiment of FIG. 7 taken along line 8-8 of FIG. 7.
Figure 9:
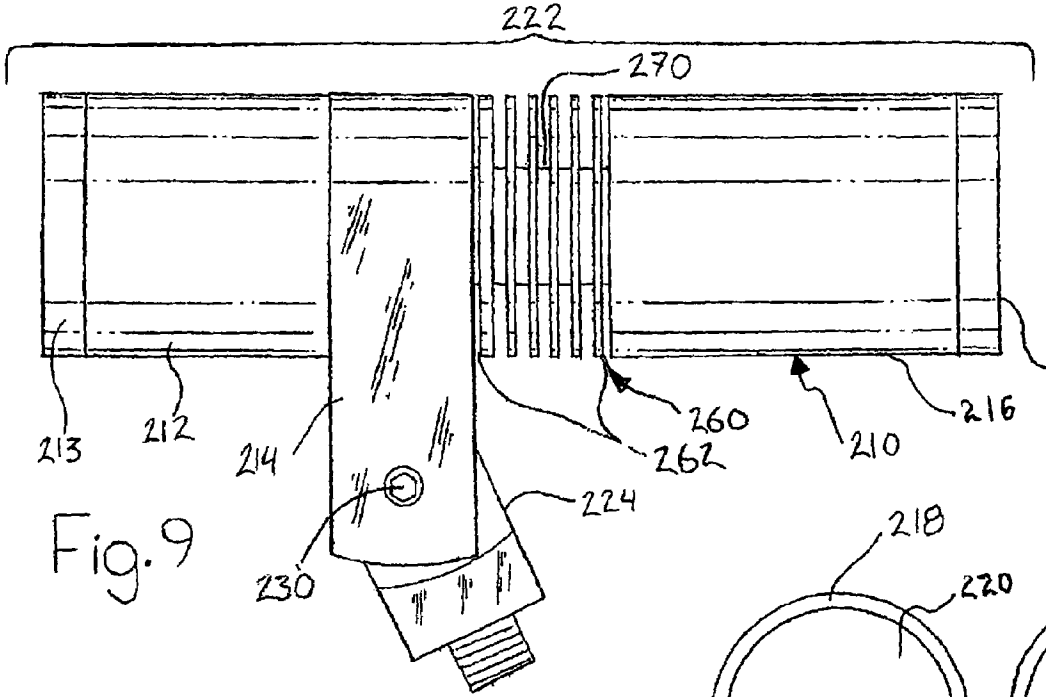
FIG. 9 is a side elevational view of a second alternative embodiment of this invention employing fins for additional radiation cooling.
Figure 12:
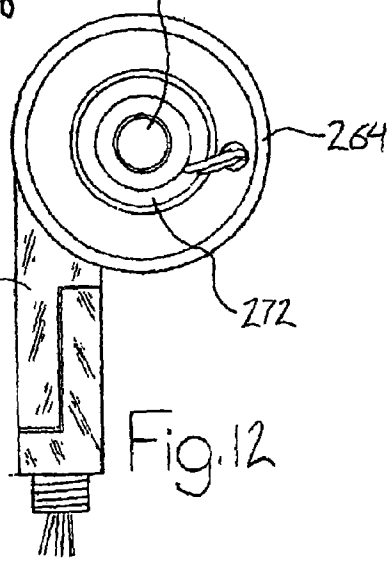
FIG. 12 is a front elevational view of the finned section of the fixture of FIG. 7.
Figure 13:
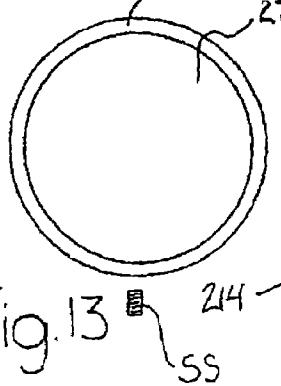
FIG. 13 is a front elevational view of the shroud or lens holder of the embodiment of FIG. 7.
Figure 10:
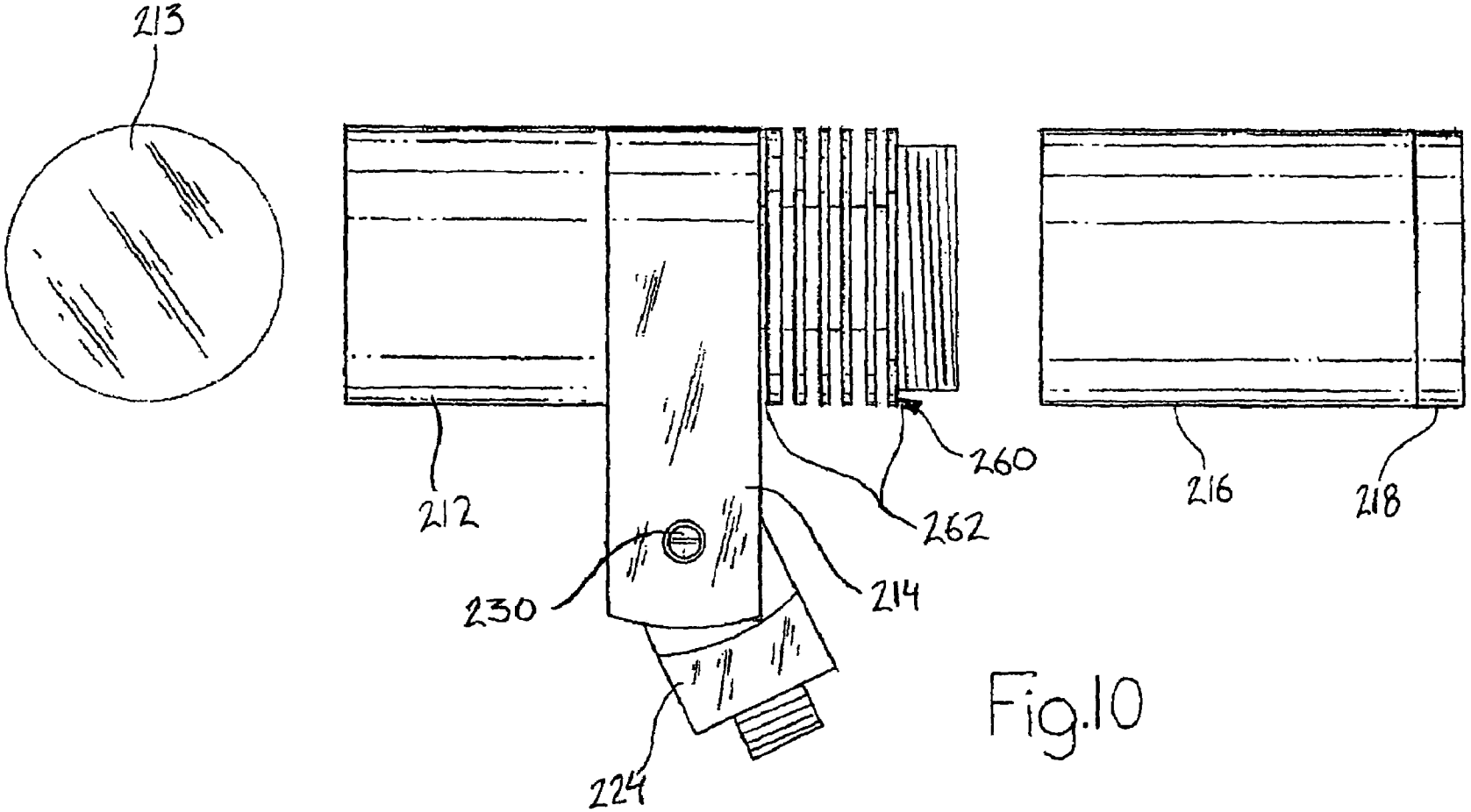
FIG. 10 is a partly exploded side view of the finned fixture of FIG. 9.

Reference is now made to FIGS. 7 and 8 for a basic version of this invention which not only serves to illustrate this invention but incorporates additional features serving to reduce the number of parts but provides equal or superior thermal isolation of the ballast and the lamp from each other and facilitates sealing the fixture and the process of wiring the fixture.

The fixture of FIGS. 7 and 8, generally designated 110 comprises a power supply housing 112 with its threaded end closure 113 secured with a locking set screw SS, a stem 114, with its swivel stem 124, a lamp housing 116 and a shroud or lens protector 118 making up the major components viewable from the exterior. These structural components bear corresponding reference numerals similar to the embodiment of FIGS. 1-6 but in the one hundred series of numerals. Additional components visible in FIGS. 7 and 8 from the exterior are two spacers, one of which, 142 appearing in both FIGS. 7 and 8 and spacer 140 appearing only in FIG. 8. These spacers 140 and 142 are actually metal washers. Spacer 140 which separates the ballast housing 112 from the stem 114 and spacer 142 which separates the stem 114 from the lamp housing 116. These spacers 140 and 142 define three adjoining air gaps 132, 134 and 136, appearing in FIG. 8 between the stem 114 and the two heat generating housings 112 and 116. The three air gaps effectively separate the two heat generation components, namely the power supply 28 in housing 112 and the lamp 136 in housing 116. The only thermal conductive path between the two housings 112 and 116 is through the spacers 140 and 142 and the fastener 146 that extends from housing 112 through the stem 114 to housing 118. The fastener 146 passing through a close fitting bore in stem 114 is in direct thermal contact with the stem 114 for heat transfer by conduction out of the fixture 110.

As shown in FIG. 8, the fastener 146F is shown as hollow with a bore of sufficient size to allow the passage of the five wires, normally plastic insulated copper. The lamp leads 126L pass entirely through the fastener 146 to the socket 134 while the power leads 126P exit the fastener 146 through a hole in its sidewall shown in dashed lines to enter a mating bore in the stem 114 to exit the fixture 110 through a similar bore or slot in the swivel stem 124 to outside power.

The only thermal conductive path between the housing 112 and 116 is via the single fastener 146 and the spacers 140 and 142 which are in intimate contact with the stem 114 which is a readily available heat sink and thermal conductor to the support for the fixture.

This embodiment has minimum openings to the housings 112 and 116 that require sealing as compared with many exterior fixtures for enhanced protection from moisture intrusion.

When the fastener 146 is hollow as shown in the cutaway section of FIG. 8 and includes a sidewall smooth edged hole H, the power leads 126P exit the fixture through that hole H and matching holes in the stem 114 and a matching slot in the swivel stem 124 to the external power source. Wiring paths are indicated in FIG. 5 partially in solid lines and when hidden by dashed lines.

In accordance with this invention feature, all wiring within the fixture 110 passes through a single sealed passage in the stem 114 in the thermal dissipation path of the fixture and which may serve to provide cooling of the leads 126P and 126L, as well.

SECOND ALTERNATE EMBODIMENT

For high intensity lighting applications, for example, 150 watt, maximum which may utilize T6 CDM Type MH lamps.

Fixtures incorporating the thermal dissipation features of the foregoing embodiments are modified in accordance with the second alternate embodiment which is shown in FIGS. 9 through 12.

The same components used in the embodiment of FIGS. 1-5 are used herein and bear the same reference numerals. The descriptions above for those figures will apply to this second alternate embodiment.

The fixture, generally designated 210 includes the power supply housing 212, the stem 214, the lamp housing 216 and the swivel stem 224. The diameter of the fixture 210 may be larger than the previous embodiments, e.g., approximately 5 in. in diameter as compared with 2½ inch diameter for lower wattage fixtures.

Figure 11:
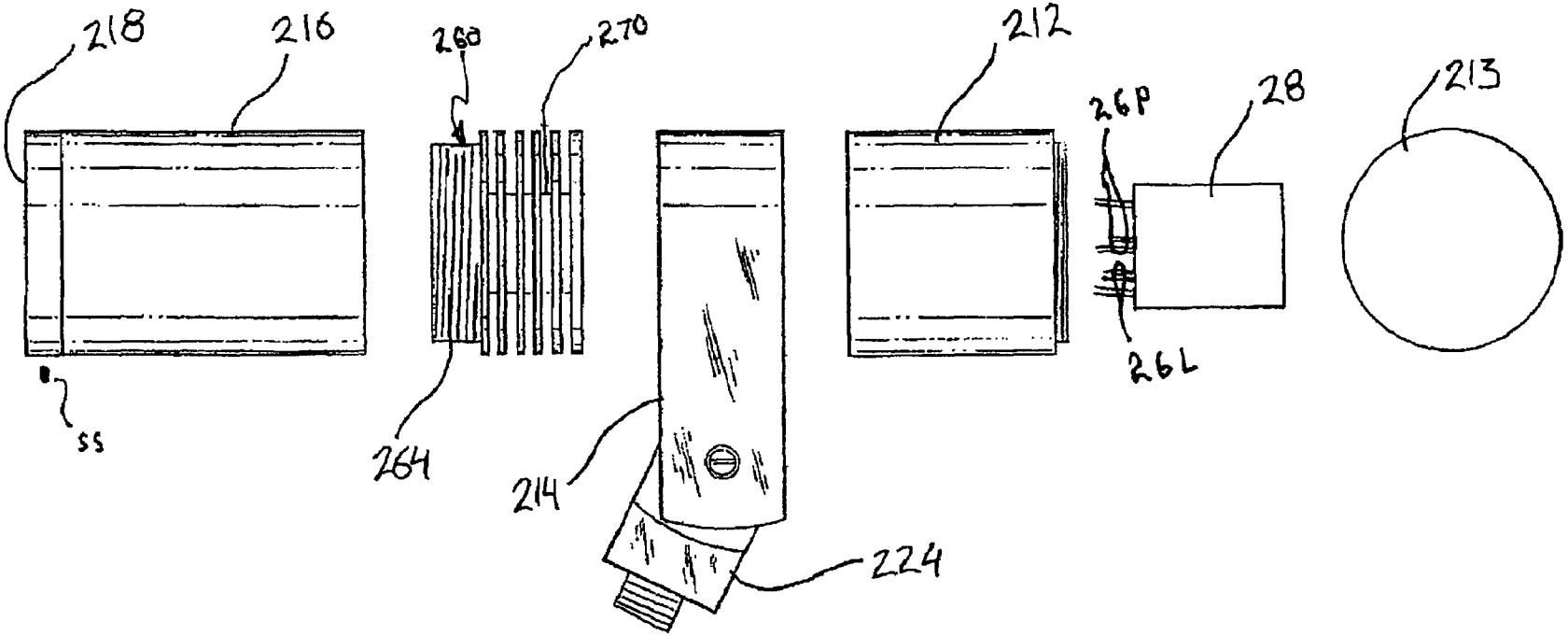
FIG. 11 is a further exploded view of the embodiment of FIG. 9.

The notable difference in this embodiment is the presence of a finned section 260 including a number of integral cooling fins 262 and a threaded end closure section 264 of FIG. 11 which seals the inner end of the lamp housing 216. The opposite or outer end of the lamp housing 216 is closed by a threaded lens mounting ring 268. A central core section 270 of the finned section 260 may be seen between the fins 262 along its central diameter. The central core 270 includes a through-hole 272, appearing in FIG. 12 allowing for the passage of leads 26L and 126L of the earlier figures to reach the lamp socket 34 as in the earlier embodiments.

The finned section 260 provides a heat radiating section in the fixture, aesthetically integrated into the fixture 210 as a whole and provides the further functions of sealing the fixture, conduction of electrical leads 26P and 26L and mounting the lamp housing 216 to the stem 214.

General

Lamp fixtures in accordance with this invention, in general, are manufactured from machined or cast aluminum and have a durable exterior coating, O rings and silicone sealant in accordance with sound manufacturing standards as defined, particularly by the Underwriters Laboratories, Inc. They employ aluminum reflectors for the lamps and flat tempered or borosilicate glass lens secured in place by silicone sealant.

The preferred lamps, depending upon the wattage requirements are as follows:

| Fixture Rating | Lamp Type | Ballast Type |
|---|---|---|
| 150 Max | T6 CDM MH | MC 150-1-F-120U |
| 100 Max | PAR 38 CDM MH | M10012-27CK-5EU |
| 70 MAX | T6 CDM MH | MC 70-1-F-120U |
| 39 MAX | PAR20 MH | M39120CK-6EUN-F |
| 20 MAX | TM CDM | RMH-20-E-LF |

Suppliers of the foregoing lamps and ballasts are well known in the lighting field.

Pre-production lighting fixtures incorporating the principles of this invention have met all of the standards of the Underwriters Laboratories, Inc. Standard 1598 for luminere including the temperature rise requirements and Canadian CSA standards C22.2 No. 250.0 and the Canadian specific standards.

The versatility of fixtures incorporating this invention to accommodate the broad range of power ratings is believed to be owed, at least in part, to the thermal dissipation capabilities afforded by this invention.

The foregoing embodiments and the descriptions are representative of the preferred embodiments of this invention and are not to be considered as limiting. Rather, the invention must be determined by reference to the following claims, as stated below and given the protection afforded by the Doctrine of Equivalents.

What is claimed is:

1. A lighting fixture comprising:

a power supply housing;

a lamp socket housing;

a lamp hood;

a stem positioned between said power supply housing and said lamp socket housing for supporting said fixture;

a power supply in said power supply housing;

a lamp socket and lamp in said lamp socket housing;

a lens in said fixture in the region of said lamp;

means securing said lamp socket housing to said stem;

means securing said power supply housing to said stem which defines an air gap between the power supply and lamp socket and between the power supply housing and the stem;

whereby thermal conduction between said power supply housing and said lamp socket housing is reduced.

2. The lighting fixture in accordance with claim 1 wherein at least one of said two securing means include a spacer member extending its respective housing and said stem, one dimension of which defines the size of said air gap.

3. The lighting fixture in accordance with claim 2 wherein said spacer member is tubular and said securing means includes a fastener enclosed by said tubular spacer member.

4. The lighting fixture in accordance with claim 3 wherein at least two tubular members and enclosed fasteners define the air gap between said power supply housing and the remainder of said fixture.

5. The lighting fixture in accordance with claim 2 wherein three tubular members and three fasteners define the air gap between one of said lamp housings and the remainder of said lighting fixture.

6. The lighting fixture in accordance with claim 3 wherein said spacer member is a washer in thermal transfer contact with at least one of said housings and said stem.

7. The lighting fixture in accordance with claim 4 wherein the number of said tubular members extend through said stem and have a length greater than the thickness of said stem thereby defining the size of said air gap.

8. The lighting fixture in accordance with claim 7 wherein the only direct thermal conductive paths in said lighting fixture between said power supply housing and said lamp socket housing is through said securing means.

9. The lighting fixture in accordance with claim 1 wherein said housings and at least a portion of said stem are cylindrical in shape.

10. The lighting fixture in accordance with claim 8 wherein the portion of said stem is partially cylindrical in the region where the stem joins said housings together;

whereby said housings and said stem present a generally cylindrical appearance.

11. The lighting fixture in accordance with claim 10 wherein said housings have a diameter in the range of 2½ to 5 inches and said air gap has a width in the order of ⅛ to ¼ in.

* * * * *